United States Patent [19]

Foster

[11] 4,205,544

[45] Jun. 3, 1980

[54] APPARATUS FOR BENDING CORRUGATED PIPE

[75] Inventor: Robert D. Foster, Houston, Tex.

[73] Assignee: H. C. Price Co., Bartlesville, Okla.

[21] Appl. No.: 920,813

[22] Filed: Jun. 30, 1978

[51] Int. Cl.[2] ..... B21D 11/04

[52] U.S. Cl. ..... 72/307; 29/157 A; 72/369; 72/383; 72/401

[58] Field of Search ..... 72/307, 383, 369, 401; 29/157 A

[56] References Cited

U.S. PATENT DOCUMENTS

| | | | |
|---|---|---|---|
| 113,167 | 3/1871 | Hoeller | 72/307 |
| 678,946 | 7/1901 | Diechmann | 72/307 |
| 748,686 | 1/1904 | Baeumle | 72/307 |
| 3,247,581 | 4/1966 | Pellizzari | 29/157 A |
| 3,670,553 | 6/1972 | Nothum | 72/307 |

*Primary Examiner*—Leon Gilden

*Attorney, Agent, or Firm*—Lowe, Kokjer, Kircher, Wharton & Bowman

[57] ABSTRACT

Corrugated pipe is bent by pinching the spiral corrugations on one side of the pipe to decrease their pitch and increase their amplitude as compared to the undeformed corrugations on the opposite side of the pipe, thereby shortening the pipe on one side. A machine for effecting deformation of the corrugations includes inner and outer clamp mechanisms which provide an inner spiral rib extending partially around the inside of the pipe and a pair of outer spiral ribs extending partially around the outside of the pipe. The clamps include hinged together clamp sections which are pivoted by hydraulic cylinders between a pipe engaging position for bending the pipe and a release position permitting advancement of the pipe. The cylinders drive the outer ribs toward one another as well as inwardly into grooves of the corrugations where their force is opposed by the inner rib which acts against the inside pipe surface at a ridge of the corrugation. The resultant pinching action deforms the portion of the corrugation engaged by the ribs such that its pitch is decreased and its amplitude is increased with respect to the undeformed portion of the corrugation on the opposite side of the pipe.

6 Claims, 8 Drawing Figures

APPARATUS FOR BENDING CORRUGATED PIPE

BACKGROUND AND SUMMARY OF THE INVENTION

This invention relates generally to the bending of conduits and more particularly to a method and apparatus for bending corrugated pipes.

With the increased use of corrugated pipe in recent years has come a corresponding need to bend such pipe into a curved shape. For example, corrugated pipe may serve as an outer jacket for smooth pipe that extends within the corrugated pipe jacket. If the smooth pipe is curved in shape, as may be the case, the corrugated pipe must be bent such that it is curved in conformity with the curvature of the smooth pipe.

At present, there is a lack of equipment for bending corrugated pipe in a satisfactory manner. The machines that have been developed for use in bending smooth conduits are not able to successfully bend corrugated pipe due to the special problems presented by the corrugations. In particular, the corrugated pipe must be bent without deforming the corrugations excessively or unevenly; otherwise, the pipe will be weakened and the advantages of the corrugations will be negated. As a consequence, conventional pipe bending techniques are not acceptable when dealing with corrugated pipe, and there is a need for a method and apparatus for quickly and easily bending corrugated pipe. It is the principal goal of the present invention to meet that need.

More specifically, it is an object of the invention to provide a method and apparatus for bending corrugated pipe in a simple and effective manner.

Another object of the invention is to provide a method and apparatus of the character described which deforms the corrugations in a uniform manner and only to the extent necessary to achieve bending of the pipe, thereby retaining the strength and other benefits of the corrugations.

Yet another object of the invention is to provide a method and apparatus of the character described which may be used to bend pipes of various sizes and configurations.

A further object of the invention is to provide a method and apparatus of the character described which is adapted to bend corrugated pipe into virtually any desired shape.

An additional object of the invention is to provide a method and apparatus of the character described wherein the pipe bending is carried out quickly and easily and without undue expense.

A still further object of the invention is to provide an apparatus of the character described which operates reliably with low maintenance requirements.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
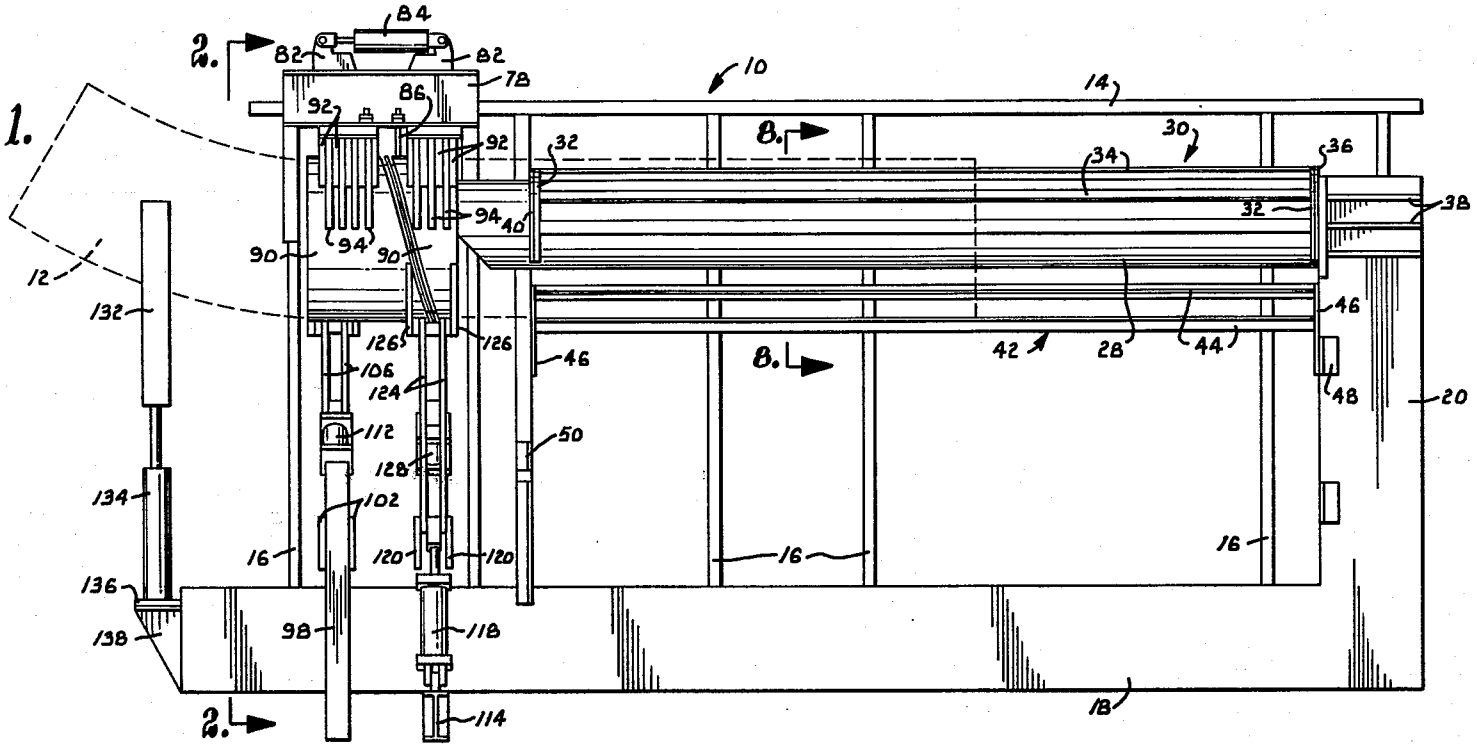
FIG. 1 is a top plan view of a machine which is constructed to bend corrugated pipe according to a preferred embodiment of the present invention, with a corrugated pipe shown in broken lines.
Figure 2:
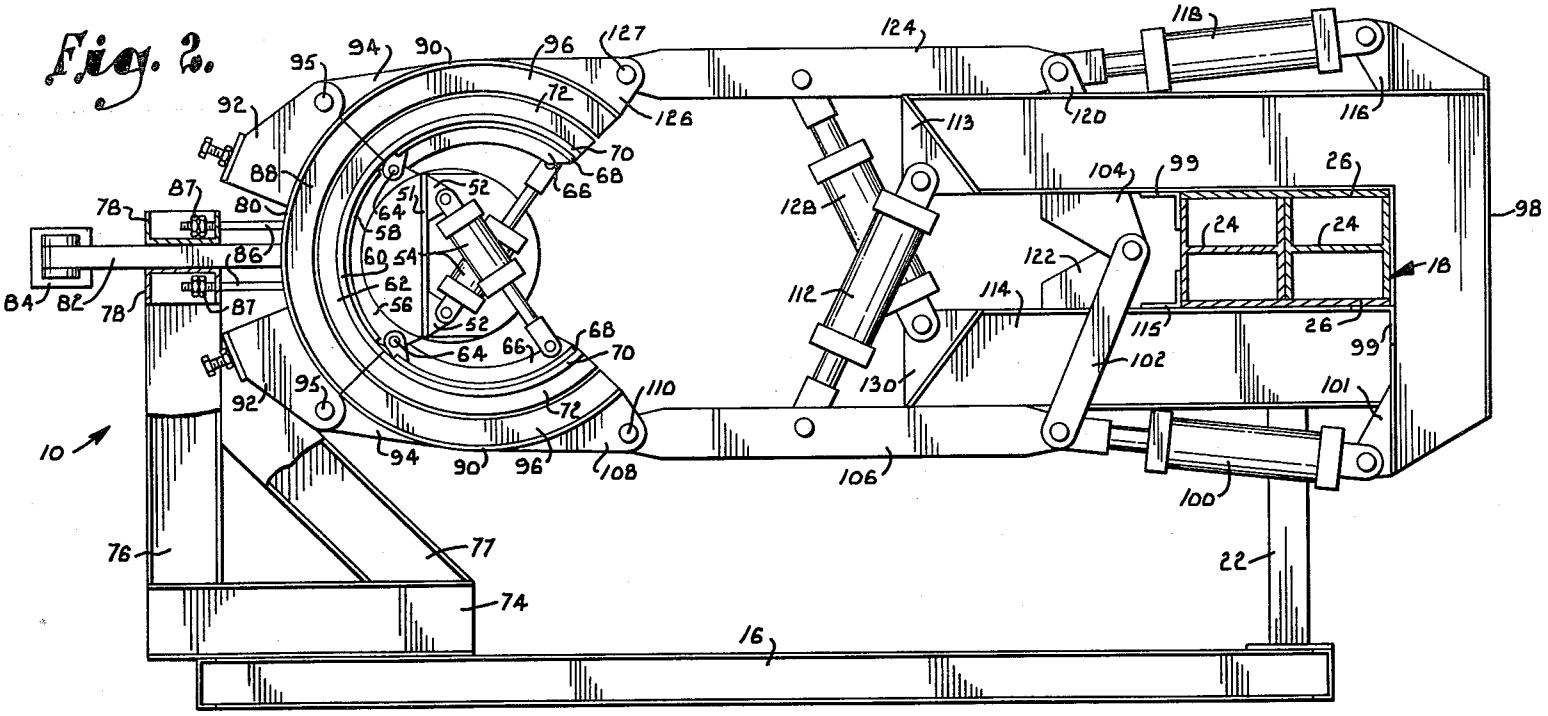
FIG. 2 is an enlarged end elevational view of the machine taken partially in section generally along line 2—2 of FIG. 1 in the direction of the arrows, with the clamp mechanisms in the pipe engaging position.
Figure 3:
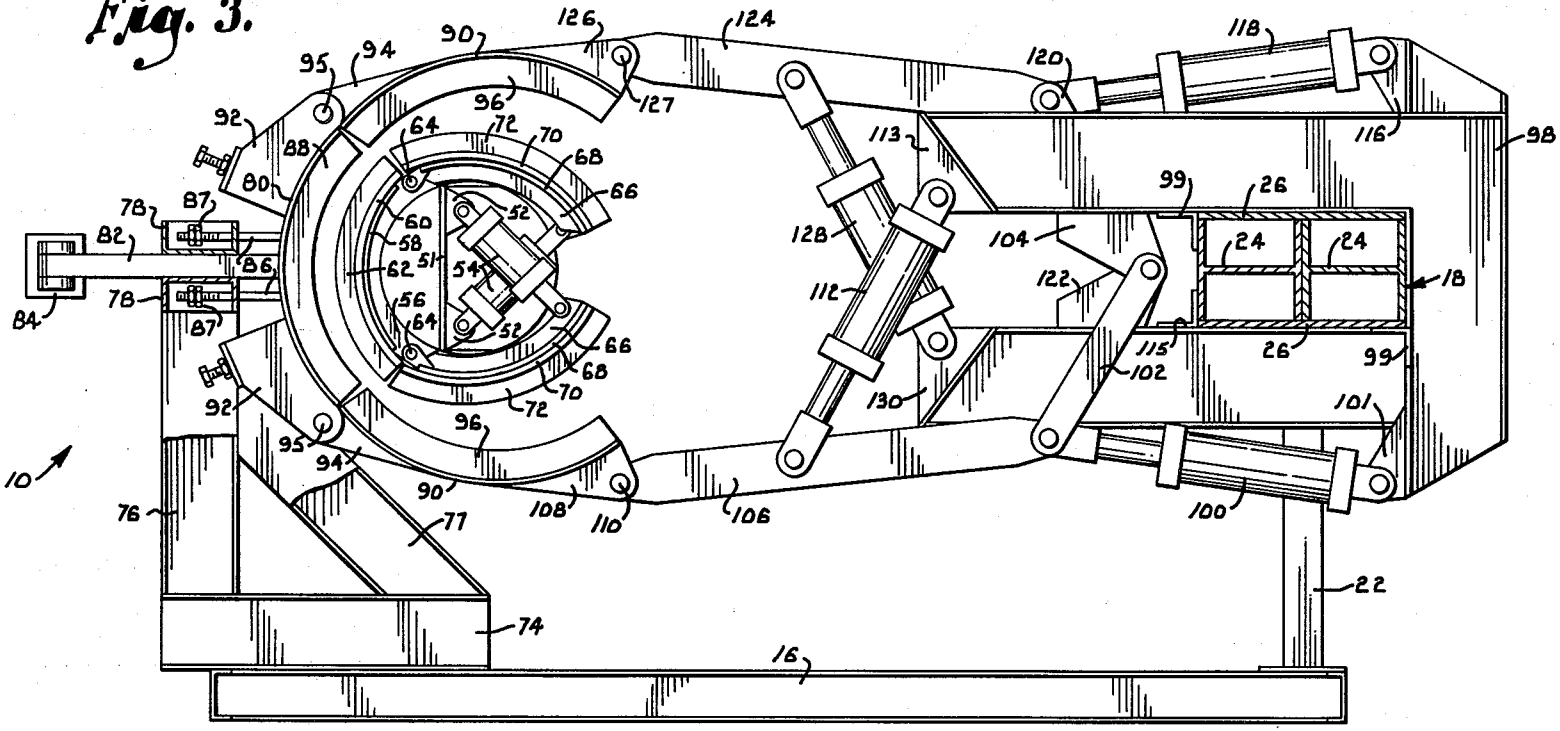
FIG. 3 is an end elevational view similar to FIG. 2 but showing the clamp mechanisms in the release position.

Referring now to the drawings in more detail and initially to FIGS. 1–3, numeral 10 generally designates a machine which is used to bend corrugated conduits such as the corrugated pipe 12 shown in borken lines in FIG. 1. The frame of the machine has a base section which includes parallel channels 14 extending along opposite sides of the machine and parallel cross channels 16 that extend between channels 14 at spaced apart locations. The channels 14 and 16 rest on the floor or another support surface to provide a stable base for the machine.

The frame further includes a pair of elevated box-like beams 18 and 20 which are mounted on top of spaced apart legs 22 (FIG. 1). The legs are secured at their bottom ends to channels 14 and 16. The longer beam 18 extends along one side of the machine and is connected end to end with the shorter beam 20 which is perpendicular to beam 18 at one end of the machine. As best shown in FIGS. 2 and 3, beams 18 and 20 are each formed by a pair of H-beams 24 which are welded to one another and to upper and lower plates 26. This construction provides the beams with a sturdy box-like configuration which is strengthened by the internal webs and flanges of the H-beams.

A horizontal cylinder or tube 28 is connected to the free end of beam 20 in cantilever fashion. Tube 28 extends parallel to beam 18 and is considerably smaller than the corrugated pipe 12 which is received on the tube during the pipe bending operation.

Figure 8:
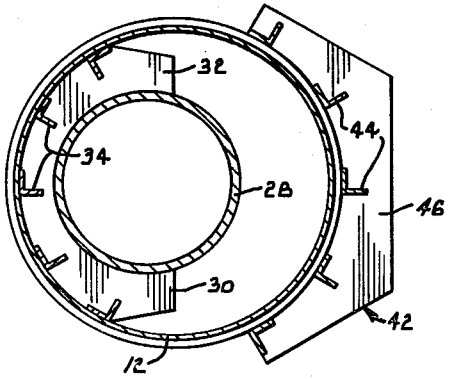
FIG. 8 is a fragmentary sectional view on an enlarged scale taken generally along line 8—8 of FIG. 1 in the direction of the arrows.

Tube 28 is equipped with a cage-like inner pipe guide 30 having at its opposite ends arcuate mounting brackets 32 between which horizontal angle members 34 extend. Referring to FIG. 1 in particular, the bracket 32 on one end of pipe guide 30 is bolted to a flange 36 which is located on tube 28 near its connection with beam 20. Gussets 38 extending from beam 20 provide reinforcement for flange 36. The bracket 32 on the opposite end of pipe end 30 is bolted in similar fashion to a flange 40 that projects outwardly from tube 28 near the end opposite flange 36. As best shown in FIG. 8, angles 34 cooperate to present a curved configuration conforming with the curvature of the inside surface of pipe 12. The flanges of angles 34 act against the inside pipe surface along less than half its circumference and on only one side of the pipe to provide resistance to the bending movement applied to the pipe.

An outer pipe guide 42 which cooperates with the inner guide 30 includes horizontal angle members 44 which extend between arcuate mounting brackets 46 located at opposite ends of the pipe guide. One bracket 46 is bolted to angle brackets 48 that are secured to beam 20. The opposite bracket 46 is bolted to a bar 50 which extends inwardly toward tube 28 from beam 18. As shown in FIG. 8, pipe guide 42 is on the opposite side of tube 28 from pipe guide 30 and it is spaced well away from the tube. The angle members 44 are arranged such that their flanges are able to contact the outer surface of pipe 12 along less than half its circumference.

Tube 28 supports an inner clamp mechanism which acts against the inside surface of the corrugated pipe 12 during the bending operation. The end of tube 28 opposite beam 20 is cut away on one side, and a bent plate 51 (see FIGS. 2 and 3) is welded to the edges of the cut away portion of the pipe. The flat end portion of plate 51 is oriented vertically. A pair of ears 52 are secured to plate 51 to provide pivotal mountings for the base ends of a pair of hydraulic cylinders 54. Ears 52 are offset both vertically and in a direction longitudinally of tube 28.

With particular reference to FIGS. 2 and 3, the curved side of tube 28 has an outwardly extending flange 56 on its end. The flange 56 has an arcuate edge to which a curved mounting plate 58 is secured. Another curved plate 60 is bolted to the outside surface of plate 58. Plate 60 conforms in size and shape with the inside surface of the corrugated pipe 12. A spiral rib 62 projects outwardly from the outer surface of plate 60.

A pair of hinge pins 64 pivotally connect curved upper and lower hinge arms 66 with the upper and lower ends of flange 56. The rod ends of cylinders 54 are pivoted to the ends of arms 56 opposite the ends that are pivoted to flange 56. Each arm 66 carries a curved mounting plate 68 on its arcuate outer edge. Plates 68 receive complemental curved plates 70 which are bolted or otherwise secured to the outer surfaces of the respective plates 68. Each plate 70 has an outwardly projecting spiral rib 72 on its outer surface.

Cylinders 54 may be extended and retracted to pivot the inner clamp assembly between the extended operating position shown in FIG. 2 and the inwardly collapsed release position shown in FIG. 3. In the position of FIG. 2, plates 60 and 70 cooperate to present a substantially continuous surface which is curved in conformity with the curvature of the inside surface of pipe 12. The upper and lower ribs 72 form end extensions of the central rib 62, and the three ribs cooperate to form a continuously extending rib which spirals in a manner to conform with the spiral corrugations of pipe 12. Ribs 62 and 72 extend for only about ¾ of the pipe circumference. In the release position of FIG. 3, the hinge arms 66 are pivoted inwardly sufficiently that the inside surface of pipe 12 is able to clear ribs 62 and 72 so that it can be advanced longitudinally, as will be explained in more detail.

An outer clamp mechanism acts against the outer surface of pipe 12 in opposition to the inner pipe clamp. With continued reference to FIGS. 2 and 3 in particular, a pair of horizontal channels 74 are secured on top of adjacent cross channels 16 at the end of the machine opposite beam 20. Vertical legs 76 extend upwardly from the outer ends of beams 74 and are braced by inclined braces 77 extending between members 74 and 76. A pair of horizontal channels 78 are welded to extend between the upper portions of legs 76. The webs of channels 78 are vertically spaced and parallel to one another.

A pair of curved plates 80 of the outer clamp mechanism are rigidly connected with the inner ends of a pair of flat arms 82 which extend horizontally through the space presented between channels 78. The outer ends of arms 82 connect with the opposite ends of the hydraulic cylinder 84. Each plate 80 has a pair of rods 86 extending outwardly through horizontally elongated slots (not shown) which are formed in the inside flanges of channels 78. Each rod 86 has nuts 87 threaded thereon to provide adjustable stops. It is apparent that extension and retraction of cylinder 84 carries plates 80 away from and toward one another.

The adjacent edges of plates 80 are spaced apart from one another and are spiral in shape. Each plate 80 has on its edge an inwardly projecting spiral rib 88 which is parallel with the rib 88 of the other plate 80. Ribs 88 are spaced apart a short distance and may be moved toward and away from one another by the action of cylinder 84.

Each plate 80 has a pair of curved plates 90 pivotally connected with its respective upper and lower ends. The outer surfaces of plates 80 are provided with a plurality of hinge arms 92 between which are fit hinge arms 94 secured to plates 90. The hinge arms 92 and 94 are connected by horizontal pivot pins 95 about which plates 90 are able to pivot relative to plates 80.

Plates 90 cooperate with the central plates 80 to form a partially cylindrical surface that conforms in curvature with the outer surface of pipe 12 when the plates are in the position shown in FIG. 2. Each plate 90 has an inwardly projecting spiral rib 96 located on its inside edge. In the position of FIG. 2, the ribs 88 and 96 of each set of plates 80 and 90 cooperate to form continuous outer ribs which extend spirally in conformity with the spiral shape of the corrugations of pipe 12.

The outer clamp mechanism is shifted between the pipe contacting position shown in FIG. 2 and the release position shown in FIG. 3 by a linkage which is mounted to beam 18. An L-shaped beam 98 has its horizontal leg extending above and well inwardly of beam 18 and its vertical leg projecting well below beam 18. Angle members 99 are welded to beam 18 and to the legs of beam 98 to rigidly mount the latter. A hydraulic cylinder 100 is pivoted at its base end to an ear bracket 101 formed on the lower end of beam 98. The rod end of cylinder 100 is pivoted between the lower ends of a pair of parallel links 102 which are pivoted at their upper ends to a bracket 104 projecting from the horizontal leg of beam 98.

Also pivoted to the rod end of cylinder 100 are a pair of parallel lever arms 106 which are pinned at their opposite ends to ears 108 projecting from each of the lower hinge plates 90. A pivot pin 110 pivotally connects arms 106 between ears 108. The connection of ears 108 to pin 110 is loose enough that the outer ends or right ends of the lower plates 90 are able to remain a fixed distance apart when the inner ends or left ends of the plates are moved toward one another. A hydraulic cylinder 112 is pivoted at its base end to a bracket 113 formed on the inner end of beam 98 and at its rod end to arms 106 at an intermediate location thereon.

A similar linkage for the upper pair of hinge plates 90 is mounted on an L-shaped beam 114 which is secured to beam 18 at a location spaced from beam 98. Beam 114 has a horizontal leg extending beneath beam 18 and inwardly thereof and a vertical leg projecting above beam 18, with a pair of angle members 115 strengthening the connections between the beams. An ear 116 on the upper end of a vertical leg of beam 114 pivotally mounts the base end of a hydraulic cylinder 118 having its rod end pivoted between the upper ends of a pair of parallel links 120. The links are pivoted at their opposite or lower ends to a bracket 122 secured to the horizontal leg of beam 114.

A pair of generally horizontal arms 124 have their outer ends pinned to the rod end of cylinder 118 and their inner ends pinned at 127 between ear plates 126 which project from each of the upper hinge plates 90. The connection of ears 126 to pin 127 is loose enough to permit the spacing between the outer ends or right ends as viewed in FIGS. 2 and 3 of the upper plates 90 to remain fixed when the inner ends of the plates are moved closer together. A hydraulic cylinder 128 is pivoted at its base end to a bracket 130 located on the inner end of beam 114. The rod end of cylinder 128 is pinned to arms 124 at a location intermediate their ends.

When cylinders 100, 112, 118 and 128 are extended, the upper and lower hinge plates 90 are pivoted from the position of FIG. 2 to the release position of FIG. 3, and the outer center plate 80 is shifted outwardly away from the inside center plate 60. Retraction of the outer cylinders effects reverse movement of the outer clamp mechanism from the FIG. 3 position to the FIG. 2 position.

A contoured board 132 (FIG. 1) assists in bending and guiding pipe 12. Board 132 is carried on the end of a hydraulic cylinder 134 which is mounted at its base end to a plate 136 secured to the end of beam 18 and reinforced by a gusset 138. Board 132 has a curved cutout area (not shown) that presents an edge conforming with the shape of the outside surface of pipe 12.

In operation, the machine 10 acts to pinch the corrugations on one side of pipe 12 while leaving the corrugations on the opposite side of the pipe in an undeformed condition. This pinching action occurs in conjunction with the bending action of board 132 and deforms the corrugations in a manner to decrease their pitch on one side of the pipe compared to the pitch of the undeformed corrugations on the opposite side of the pipe. Simultaneously, the amplitude of these corrugations is substantially increased. Consequently, the corrugated pipe is shortened on one side so that bending of the pipe is effected.

Pipe 12 is received on the machine with the clamp mechanisms in the release position of FIG. 3 so that the pipe may be inserted through the clamps and onto the support tube 28. The inner pipe guide 30 contacts the inside surface of pipe 12 on one side and the outer pipe guide 42 contacts the outside surface of the pipe on the opposite side. When the initial corrugation that is to be deformed is properly located between the inner and outer clamps, the inner cylinders 54 are extended and the outer cylinders 100, 112, 118 and 128 are retracted. This moves the clamps from the release position of FIG. 3 to the clamping position of FIG. 2. In the latter position, which is also the position shown in FIG. 4, the two outer ribs formed by the cooperating ribs 88 and 96 are located against the outside surface of pipe 12 in adjacent ruts or grooves **12*a*. The single inner rib formed by ribs 62 and 72 is located inside of the pipe against the inside surface of the crest or ridge 12*b* formed between grooves 12*a*. Due to the spiral configuration of the ribs, they are able to conform with the spiral shapes of grooves 12*a* and ridges 12*b***.

After the clamps have been moved to the position shown in FIG. 2, cylinders 54, 112 and 128 are held in place while cylinders 100 and 118 continue to retract, accompanied by retraction of cylinder 84. The action of the retracting cylinders moves ribs 88 from the FIG. 4 position to the FIG. 5 position. Due to the arrangement of the linkage for the outer clamp mechanism, retraction of cylinders 100 and 118 pulls the outer clamp members to the right (FIG. 2), thereby forcefully driving ribs 88 into grooves **12*a* in opposition to the force of rib 62 acting against the inside surface of ridge 12*b* (see FIG. 5). In addition, approximately half of the length of each end rib 96 is driven against the pipe, although with less travel than ribs 88** since the end ribs engage the top and bottom portions of the pipe.

At the same time, retraction of cylinder 84 moves ribs 88 closer together. The inner or left end portions of the end ribs 96 are similarly moved closer together, although to a lesser extent because of their relatively remote location from arms 82. Retraction of cylinder 84 does not move the outer ends of ribs 96, with the loose connection of ears 108 and 126 to pins 110 and 127 accommodating the resultant pivotal movement of the end ribs 96 about their outer ends.

Figure 5:
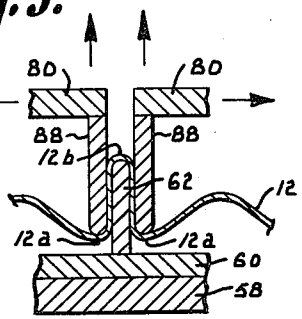
FIG. 5 is a diagrammatic view similar to FIG. 4 but showing the ribs moved to pinch the corrugation.
Figure 4:
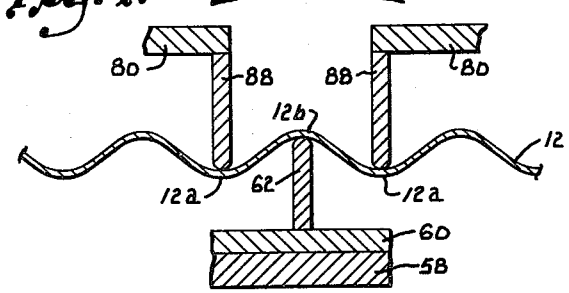
FIG. 4 is a diagrammatic view showing the pipe engaging ribs in position to begin pinching one of the pipe corrugations.

The portion of the corrugation engaged by ribs 62 and 88 is crimped or pinched as ribs 88 move toward ribs 62 and also toward one another from the FIG. 4 to the FIG. 5 position. The portions of the corrugations engaged by the center ribs is thereby deformed such that its pitch is decreased and its amplitude is increased. The portions of the corrugations engaged by ribs 96 are similarly deformed although to a lesser extent and in a gradual manner. The deformation of the corrugation gradually decreases from left to right along ribs 96 due to the gradual reduction of the pinching or clamping action along the ribs that results from the construction of the clamp mechanism. Simultaneously with the pinching effected by the ribs, cylinder 134 is extended such that board 132 applies a movement force to the pipe which assists in bending it.

Figure 6:
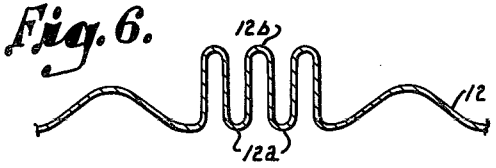
FIG. 6 is a diagrammatic view showing a portion of a pipe which has been bent according to the invention.

The overall result is that the portion of the corrugation engaged by ribs 62 and 88 is fully deformed in the manner shown in FIGS. 5 and 6. The deformation gradually decreases along the top and bottom portions of the pipe, while the corrugation is not deformed appreciably on the side of the pipe opposite ribs 88. The decrease in the pitch of the corrugation on one side shortens that side of the pipe in comparison to the undeformed side, thereby bending the pipe in cooperation with the bending movement applied by board 132 as cylinder 134 is extended. The gradual decrease in the extent of the deformation along the top and bottom portions of the pipe provides the pipe with a smoothly curved bend and results in uniform deformation of the corrugations which is only as great as necessary to effect the desired bend.

After pinching of the initial corrugation has been completed, the clamps are moved to the release position of FIG. 3 to permit pipe 12 to be manually advanced longitudinally by a distance of one corrugation. The next corrugation is then deformed in the manner described to decrease its pitch on one side, and the pinching is thereafter carried out successively for each corrugation necessary to effect the desired bending of the pipe. In addition to the pivotal motion of the end sections of the inner and outer clamps in moving from the pipe engaging position to the release position, the center section 80 of the outer clamp is shifted linearly away from the center section 60 of the inner clamp, thus providing adequate room for advancement of the pipe.

Figure 7:
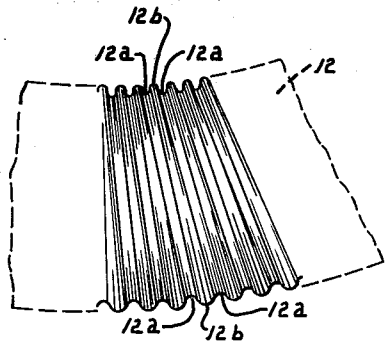
FIG. 7 is a fragmentary plan view of a corrugated pipe which has been bent according to the invention.

Since the central ribs 88 engage only about ¼ of the circumference of the pipe, the pipe is shortened on only one side and is thereby gradually and smoothly bent toward the side of the pipe on which the corrugations are deformed. This is best shown in FIG. 7. It has been found that the corrugations along approximately 7 feet of a pipe 10 feet long may be deformed to provide a smooth 90° bend in the pipe while leaving straight pipe sections on each end.

The curved edge of guide board 132 engages the side of a pipe having the undeformed corrugations. The guide board, in cooperation with the action of cylinder 134, thereby provides assistance in bending and guiding the pipe 12. The leading end portion of pipe 12 which projects beyond the end of the machine may be supported in any suitable manner.

The pipe guides 30 and 42 contact the inside and outside surface of pipe 12 along a substantial portion of its length and on opposite sides of the pipe. The pipe guides thus maintain the pipe in the proper position and alignment while accommodating any irregularities or imperfections in the pipe and providing resistance to the bending movement applied to the pipe. Pipe guides 30 and 42 are able to guide pipes of slightly different diameters such as those differing by about 1 inch in diameter. When handling substantially larger or smaller pipe, the guides may be removed and replaced by additional pipe guides which are constructed to accommodate the size of pipe that is to be bent.

The clamp mechanisms are also constructed to readily accommodate pipes of various sizes. When the diameter of the pipe being handled varies, the outer clamp sections 80 and 90 may be removed and replaced by clamp sections of the appropriate size. Similarly, the end sections 70 of the inner clamp sections in circumstances where the pipe diameter varies only slightly, such as by about 1 inch. However, when the size variation is considerable as from 26 inch pipe to 44 inch pipe, for example, it is necessary to install a jig fixture (not shown) on the inner clamp mechanism to accommodate the larger pipe. The guide board 132 may also be removed and replaced by a different board when the pipe diameter differs substantially.

Although it is contemplated that the corrugated pipe will normally be bent in a single direction, it is to be understood that multiple or compound bends may be effected by the machine to provide various shapes in addition to simple elbows. Also, advancement of the pipe longitudinally may be carried out in any desired fashion, either manually of through mechanical systems incorporating automatic indexing from one corrugation to the next.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. Apparatus for bending a conduit having a plurality of corrugations thereon presenting adjacent ridges and grooves in the external surface of the conduit, said apparatus comprising:

a frame adapted to receive and support the conduit;

an inner clamp member having an inner rib element presenting a conduit engaging surface having a generally arcuate shape and a size and length to extend partially around the inside surface of the conduit, said conduit engaging surface adapted to engage the inside surface of said conduit at one of said ridges;

an outer clamp member having spaced apart outer rib elements each presenting a conduit engaging surface and having a generally arcuate shape and a size and length to extend partially around the outside surface of the conduit, said conduit engaging surfaces of said outer rib elements adapted to engage the outside surface of said conduit at adjacent grooves on either side of said one ridge; and means for effecting relative movement in opposite directions between said inner and outer clamp members and also for effecting movement of said outer rib elements toward each other whereby the pitch of said groove is decreased and the amplitude thereof is increased.

2. Apparatus as set forth in claim 1, wherein:

said inner and outer clamp members each include a plurality of sections pivotally coupled with one another; and said means for effecting relative movement including power means operable to effect relative pivotal movement of said sections between the conduit engaging position and a release position wherein said surfaces are spaced apart for relative axial movement between the conduit and said clamp members.

3. Apparatus as set forth in claim 2, wherein:

said inner clamp member includes a center section and a pair of end sections pivotally coupled with opposite ends of said center section;

said outer clamp member includes a center section and a pair of end sections pivotally coupled with opposite ends of said center section; and said power means is operable to effect pivotal movement of each pair of end sections relative to the corresponding center section between the conduit engaging position and the release position.

4. Apparatus as set forth in claim 3, wherein:

said center sections of the inner and outer clamp members are mounted for generally linear relative movement toward and away from one another; and said power means is operable to effect relative movement of said center sections generally toward and away from one another between the conduit engaging position and the release position.

5. Apparatus as set forth in claim 4, wherein said corrugations are generally spiral in shape and said inner and outer rib members each presents a generally spiral configuration.

6. Apparatus as set forth in claim 1, wherein said inner and outer clamp members cooperate to effect a gradual variation in the extent of the change of pitch of the corrugations along said portion of the circumference of the conduit.

* * * * *